US007077292B2

(12) United States Patent
Turano

(10) Patent No.: US 7,077,292 B2
(45) Date of Patent: Jul. 18, 2006

(54) DEVICE FOR DISPENSING FLUID AND SEMI-DENSE SUBSTANCES PACKAGED IN FLEXIBLE SEALED SACHETS

(75) Inventor: Giacomo Turano, Baldissero Torinese (IT)

(73) Assignee: Prodotti Industriali S.r.l., Turin (IT)

( * ) Notice: Subject to any disclaimer, the term of this patent is extended or adjusted under 35 U.S.C. 154(b) by 95 days.

(21) Appl. No.: 10/852,675

(22) Filed: May 24, 2004

(65) Prior Publication Data

US 2004/0238565 A1 Dec. 2, 2004

(30) Foreign Application Priority Data

May 23, 2003 (IT) ..... TO2003A0383

(51) Int. Cl.
*B65D 35/28* (2006.01)

(52) U.S. Cl. ..... 222/103

(58) Field of Classification Search ..... 222/92, 222/95, 103
See application file for complete search history.

(56) References Cited

U.S. PATENT DOCUMENTS

| | | | | |
|---|---|---|---|---|
| 2,903,161 | A | 10/1959 | Stahmer | 222/81 |
| 3,211,341 | A | 10/1965 | Bailey | 222/103 |
| 3,262,605 | A * | 7/1966 | Madden et al. | 222/103 |
| 3,450,309 | A * | 6/1969 | Millo | 222/103 |
| 5,105,984 | A * | 4/1992 | Kazimir | 222/103 |
| 5,890,625 | A | 4/1999 | De Laforcade | 222/103 |
| 6,315,165 | B1 * | 11/2001 | Regan | 222/103 |

FOREIGN PATENT DOCUMENTS

| | | |
|---|---|---|
| DE | 101 10 372 A | 9/2002 |
| EP | 0226290 | 6/1987 |
| FR | 1335606 | 8/1963 |
| FR | 1524378 | 5/1968 |

* cited by examiner

*Primary Examiner*—Joseph A. Kaufman
(74) *Attorney, Agent, or Firm*—Heslin Rothenberg Farley & Mesiti P.C.; Victor A. Cardona, Esq.

(57) ABSTRACT

Device for dispensing fluid and semi-dense substances in flexible sealed sachets including two valves mutually connected at one end and delimiting an interstice for housing at least one sachet in order that, in use, the mutual closure of the two valves produces the squeezing of the sachet and the dispensing of the substances contained therewithin following its opening.

12 Claims, 4 Drawing Sheets

DEVICE FOR DISPENSING FLUID AND SEMI-DENSE SUBSTANCES PACKAGED IN FLEXIBLE SEALED SACHETS

CROSS REFERENCE TO RELATED APPLICATIONS

This application claims priority from Italian Patent Application No. TO2003A000383, filed May 23, 2003, the entire disclosure of which is incorporated herein by reference.

FIELD OF THE INVENTION

The present invention is directed to a device for dispensing fluid and semi-dense substances packaged in flexible sealed sachets. Substances contained in the sachets may include one and two-component glues, soaps, creams, alimentary sauces etc.

To dispense these products the relative flexible sachets must be opened on one side, usually by tearing or cutting, and then squeezed to allow the fluid or semi-dense substances to come out. This operation is anything but easy, taking into consideration the more and more soft consistency of the sachet while the substance is coming out therefrom, with the practical difficulty of obtaining the total emptying of the sachet with consequential waste of the substance contained inside.

There is the risk, anything but infrequent, that the fluid or semi-dense substance coming out of the sachet can be dispensed incorrectly, thus contaminating undesired zones in addition to the user's hand which is squeezing the sachet. This inconvenience, simply irritating in case of hygiene or alimentary products, can create serious consequences in case of glues and adhesives, in particular of the two-component type.

SUMMARY OF THE INVENTION

The object of this invention is to overcome the above inconveniences, and to provide a dispensing device which overcomes problems connected to the intrinsically soft nature of the sachets, making the dispensing of the substances not only more practical and easier for the user, but also safer.

According to the invention, this aim is met by a dispensing device to dispense fluid and semi-dense substances packaged in flexible sealed sachets, whose essential feature resides in that it comprises two generally rigid valves mutually connected at one end and delimiting therebetween an interstice for housing at least one sachet having an openable side projecting out from the other end of the two valves in order that, when in use, the mutual approaching of said two valves produces the progressive squeezing of the or each sachet and the dispensing of the substance contained therewithin following the opening of the said openable side.

According to a preferred embodiment of the invention the ends of mutual connection of the two valves are connected in a swingable way to a base, by means of which the or each sachet inserted within the device can be kept in an erect position after opening thereof.

These ends of mutual connection of the two valves are furthermore conveniently equipped with anchoring means of the side of the sachet opposite to the openable side: these anchoring means may, for example, consist of at least one pin borne by one valve and engageable within a complementary seat of the other valve. The pin is arranged to cross a corresponding through hole provided at the side of the or each sachet opposite to said openable side.

According to another advantageous characteristic of the invention, the two valves are fitted with one-directional positioning and fixing means designed to prevent their mutual opening, thus avoiding the consequent risk of loss of control of the dispensed contents of the or each sachet.

The surfaces of the two valves which delimit the interstice the or each sachet can be flat or, more conveniently, convex so as to guarantee, upon squeezing of the or each sachet, a more complete exit of the substances contained therewithin.

According to another advantageous aspect of the invention, the ends of the two valves opposite to those of mutual connection are formed in a spatula shape, so as to allow an easy application of the substances coming out of the or each sachet and, in case of two-component substances, even a more efficient mixing together.

BRIEF DESCRIPTION OF THE DRAWINGS

Further advantages of the invention will be evidenced in the detailed description which follows, with reference to the attached drawings, provided purely as an non limiting example, of which.

DETAILED DESCRIPTION OF THE INVENTION

Figure 1:
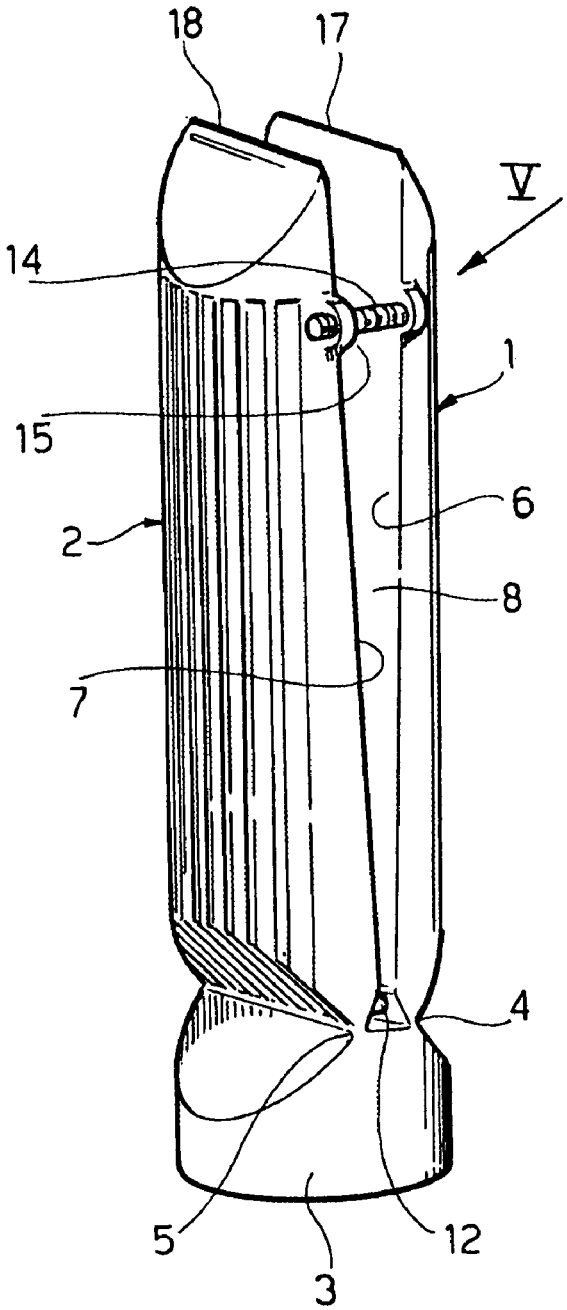
FIG. 1 is a perspective schematic view of a dispensing device according to a first embodiment.
Figure 5:
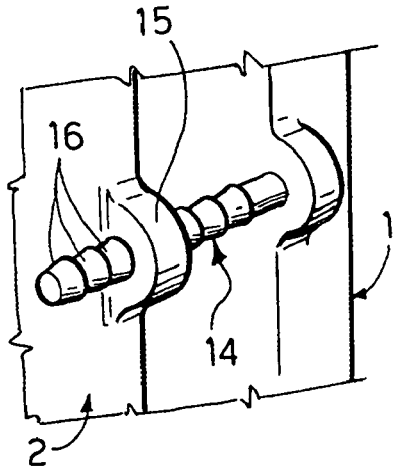
FIG. 5 is a perspective view which shows in an enlarged scale the item indicated by the arrow V in FIG. 1.
Figure 7:
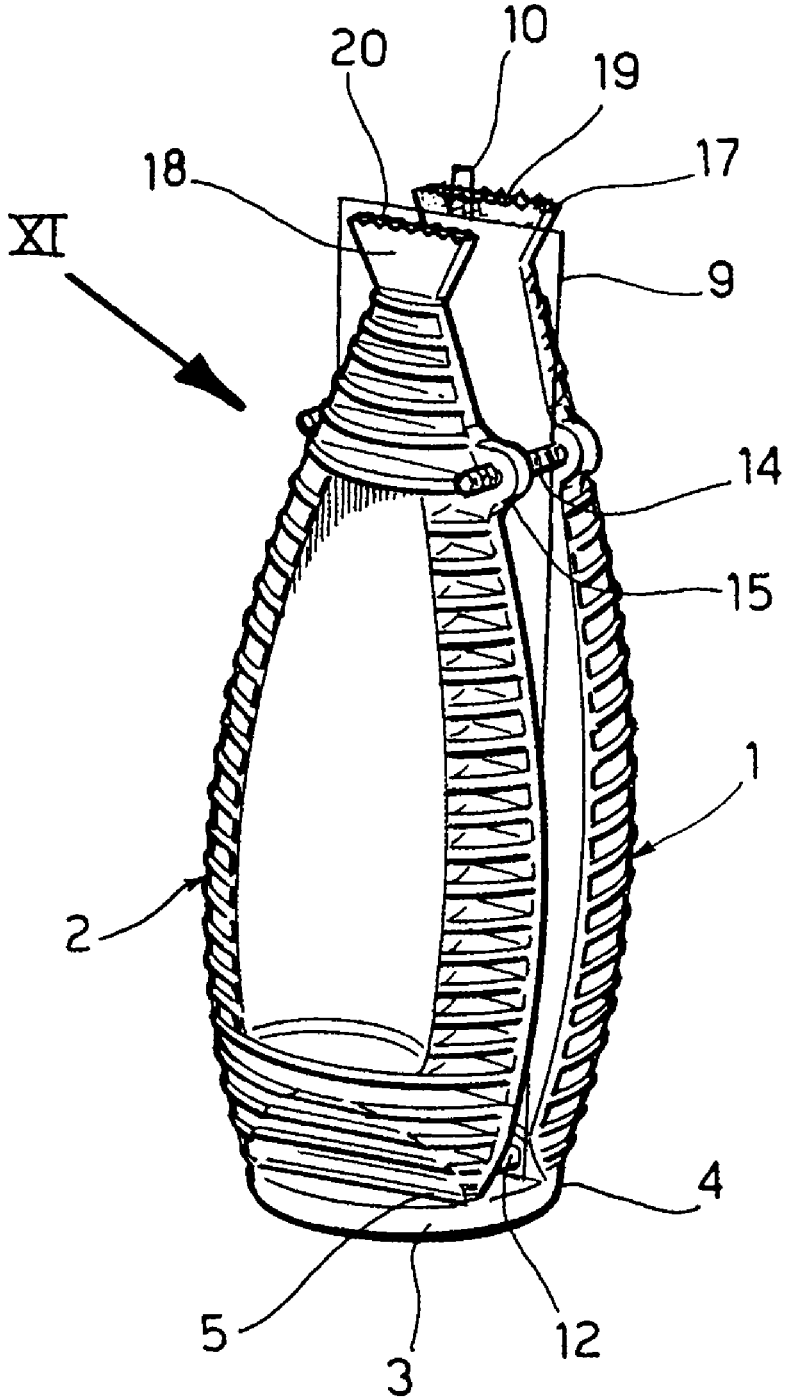
FIG. 7 shows a variation of FIG. 1.

Referring initially to FIGS. 1 and 5, a first embodiment of the dispensing device according to the invention includes a pair of opposite valves 1, 2 with a generally rigid structure, having a lengthened shape and connected to a base 3. In a preferred embodiment, the valves 1, 2 and the base 3 are formed by one piece of molded plastic material: the lower ends of the valves 1 and 2 are accordingly connected to the base 3 in a pivotal fashion by means of respective integral flexible hinges 4, 5 through which the valves 1 and 2 are reciprocally movable angularly between a spaced-apart position, represented in FIGS. 1 and 2, and a mutually closed position represented in FIG. 3.

It is important to point out that the base 3 is not strictly necessary, and that the lower ends of the valves 1, 2 can be connected together in articulated way directly instead of indirectly. However, as it will be seen in the following, the base 3 is useful to position the device in an erect position when not being used.

The internal facing surfaces the two valves 1, 2, indicated as 6, 7 are, in the case of the described example, substantially flat and define therebetween an interstice 8 intended to house one or two flexible sealed sachets 9, as shown in the drawings.

Figure 6:
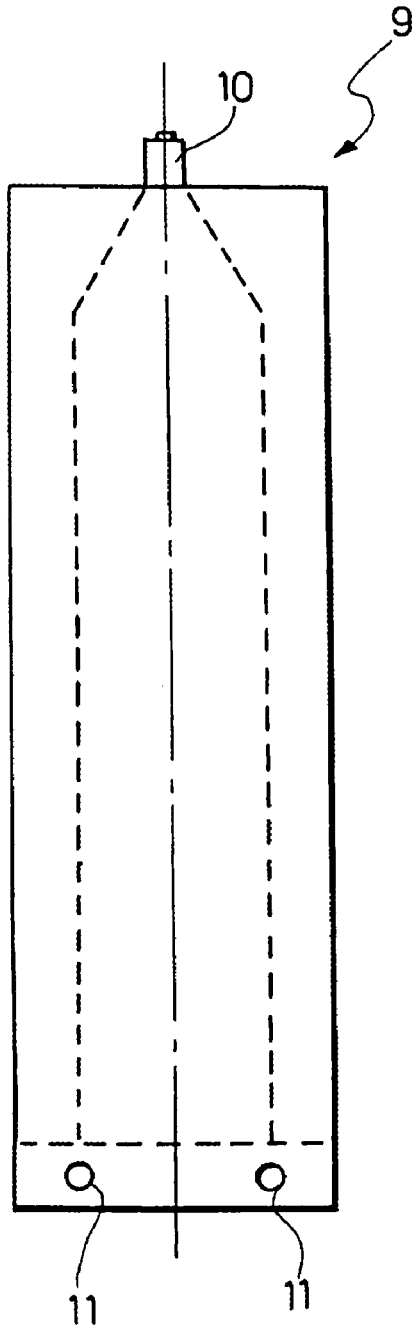
FIG. 6 is a schematic and enlarged elevational view of a flexible sachet used in the dispensing device according to the invention.

As illustrated in more detail in FIG. 6, the or each sealed sachet 9 has a generally rectangular shape and is sealingly closed, e.g. by heat-welding along its sides. The cavity of the or each sealed sachet 9 is filled with a fluid or semi-dense substance, which could consist of for example, a mono or two component adhesive, a cream or soap, a toothpaste, an alimentary sauce or similar. To allow the substance to come out, the or each sachet 9 has on one end a hollow appendage 10 which can be opened by means of tearing or cutting. The opposite end of the or each sachet 9 presents, inside its sealed border, a pair of holes indicated by 11 for reasons explained in the following. According to an alternative not illustrated just one central hole 11, or a higher number of such holes could be provided.

Figure 4:
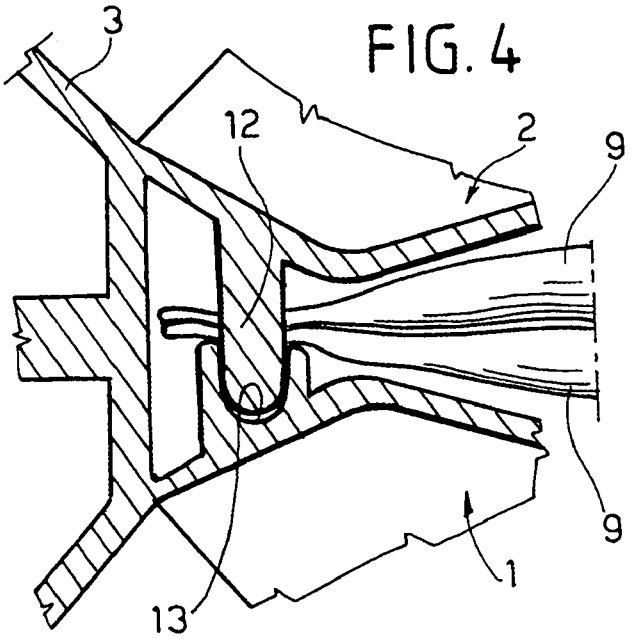
FIG. 4 shows in an enlarged scale the item indicated by the arrow IV in FIG. 3.

The or each sachet 9 is inserted inside the interstice 8 delimited by the two valves 1, 2 and the related holes 11 are used to anchor in proximity of the base 3, for example as represented in more detail in FIG. 4. A pair of transversal pins 12 projecting from the valve 2 in proximity of the bottom of the interstice 8 pass through the holes 11 of the sachet(s) 9 and engage within corresponding seats 13 formed by the other valve 1. This type of engagement can be by pressure or clicking or snap fitting, in order to block each sachet 9 inside the device.

The device according to the invention is also fitted with a unidirectional positioning and retaining system to allow the mutual closing between the valves 1, 2 while avoiding subsequent re-opening. In the case of the example illustrated such positioning and retaining system it includes a pair of transversal indented spines 14 projecting out from the opposite sides of the valve 1, at a distance from the base 3, engaged within respective annular bosses 15 correspondingly provided on the opposite sides of the other valve 2. As illustrated in greater detail in FIG. 5, the indentations of the transversal spines 14 are formed as annular saw teeth 16.

The pins 12 and the seats 13 as well as the indented spines 14 and the annular bosses 15 are conveniently formed in one molded piece with the valves 1, 2 and the base 3.

Figure 2:
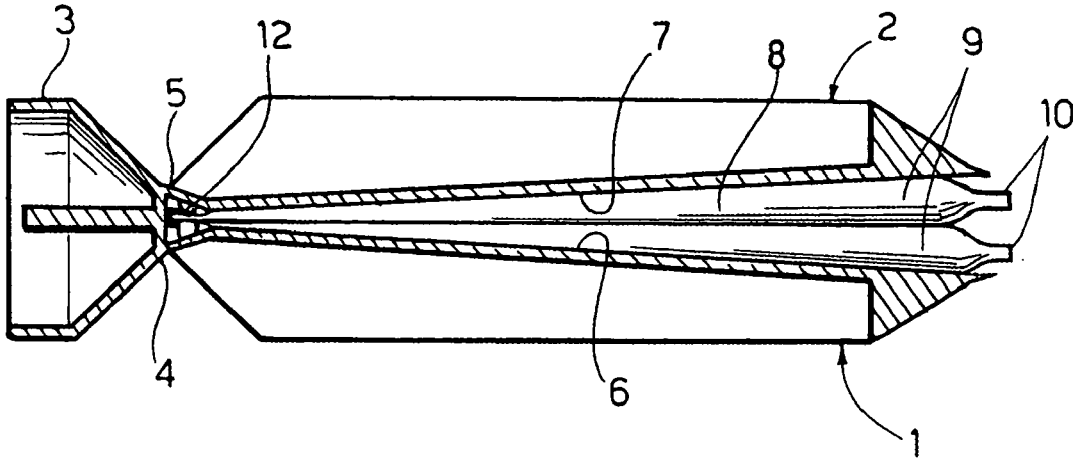
FIG. 2 is a partial longitudinal section of the device in FIG. 1 in a first stage of operation.
Figure 3:
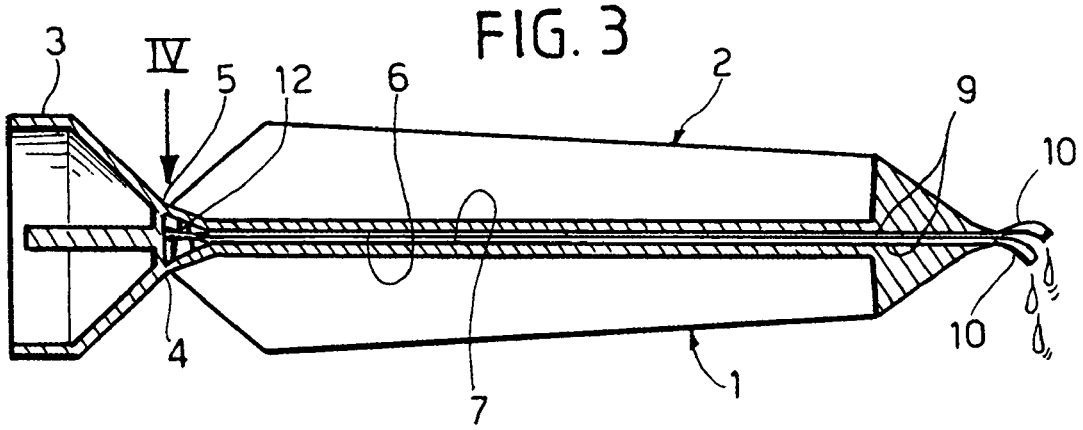
FIG. 3 is an analogous view of FIG. 2 in a second stage of operation.

FIGS. 2 and 3 show operation of the device.

After the or each flexible sachet 9 has been anchored within the interstice 8 as clarified in the following through the pins 12 engaged into the seats 13, the two valves 1, 2 are brought together to create a first stage engagement between the indented spines 14 e annular bosses 15, as represented in FIG. 1. In this way, the or each sachet 9 is kept substantially undeformed.

To proceed with the dispensing of the substances contained in the sachet(s) 9 is sufficient to open by tearing or cutting the related appendage 10, and thereafter proceed to a progressive mutual closure of the valves 1, 2 from the spaced-apart position in FIG. 2 towards the closed position in FIG. 3. By this operation the substances contained in the sachet(s) 9 are progressively squeezed out from the related opened ends 10 following the pressure applied by the internal surfaces of 6 and 7 of the two valves 1, 2.

As explained previously, the indented spines 14 avoid the return of the valves 1, 2 towards the closed position, also providing a dosage indication of the substances dispensed.

To ease the closing manoeuvre between the valves 1 and 2, their external surfaces can be shaped with surfaces of gripping and pushing, whose design can also provide a pleasant aspect to the device. Furthermore, the ends of the valves 1, 2 opposite to the base 3, indicated as 17 and 18, can be shaped as a function of the final use of the device. For example, in case the substances contained in the sachets 9 consist of two-component adhesives or anyway of substances which have to be mixed, the ends 17 and 18 can be formed as applicator and mixing spatula.

The general arrangement of the device, and in particular that of the valves 1, 2, can be widely varied with respect to that described in reference to FIGS. 1 and 3: a possible variation is represented in FIGS. 7 and 9 and 10, 11, in which similar or identical parts already described previously are indicated with the same reference numbers.

This variant differs from the solution described previously essentially in connection with the shape of the valves 1, 2, which is wider towards the base 3, for the conformation of the internal surfaces 6 and 7 of each of the valves 1 and 2, and finally for the configuration of the ends 17 and 18.

Figure 8:
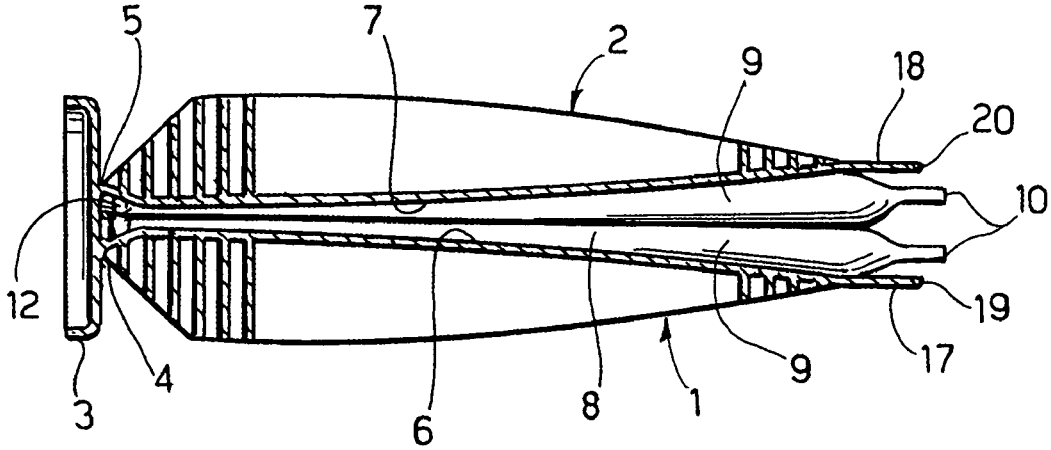
FIG. 8 is a partial longitudinal section of FIG. 7 in a first stage of operation.
Figure 9:
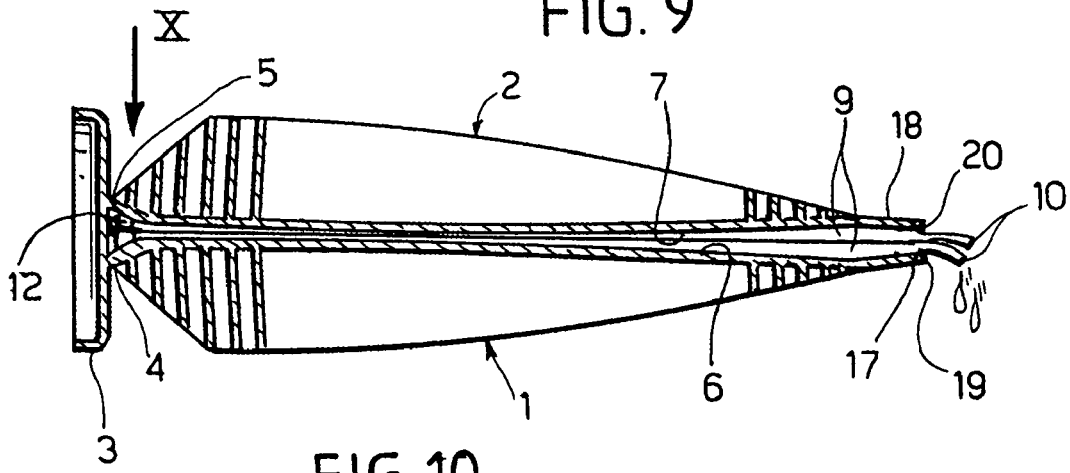
FIG. 9 is a analogous view of FIG. 8 in a second stage of operation.
Figure 10:
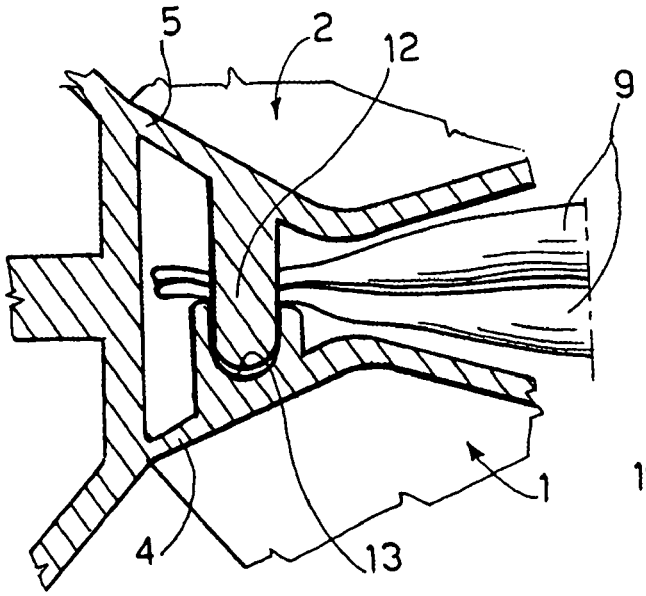
FIG. 10 shows in better detail the item indicated by arrow X in FIG. 9.
Figure 11:
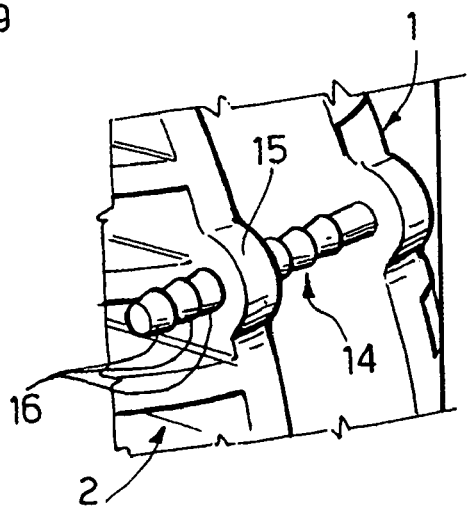
FIG. 11 shows in an enlarged scale the item indicated by the arrow XI in FIG. 7.

With regards to the internal surfaces 6, 7 of the valves 1 and 2, these, unlike the previous solution, are convex instead of flat: this guarantees, as illustrated in FIGS. 8 and 9, a more correct and complete squeezing of the flexible sachet(s) 9 starting from the bottom, i.e. its anchoring side by means of the holes 11 on the device.

As to the ends of 17 and 18 of the valves 1, 2, these have a relatively thin spatula-like arrangement which is generally trapezoidally shaped, with a longer base facing opposite to the base 3 and formed with indentations 19, 20.

The arrangement of the anchoring system of the or each sachet 9 by means of pins 12 and seats 13 on one side, and that of the positioning and non-return system formed by the indented spines 14 and annular bosses 15 is substantially analogous to that described with reference to the previous embodiment.

Of course, the details of construction and the embodiments can be widely varied with respect to what described and illustrated, without thereby departing from the scope of the present invention as defined in the claims which follow. Thus, the term "sealed flexible sachet" as used in the description and claims attached is intended to be comprehensive of containers which are structurally different but functionally equivalent to a sachet or bag, such as for example collapsable metal or plastic tubes and similar elastically or plastically deformable packagings.

What is claimed is:

1. A device for dispensing fluid and semi-dense substances packaged in flexible sealed sachets, comprising two generally rigid valves mutually connected at one end and delimiting an interstice therebetween for housing at least one flexible sachet having an openable side protruding from the other end of said two valves in order that, when in use, mutual approaching of said two valves produces a progressive squeezing of the at least one sachet and the dispensing of the substance contained therewithin following opening of said openable side; and wherein said two valves are provided with unidirectional positioning and retaining means to prevent their mutual opening, said unidirectional positioning and retaining means including a pair of indented transverse pins carried by one of said valves in proximity to said end thereof opposite to said connecting end to the other valve, and a pair of holes correspondingly provided to the other valve for irreversible engagement of said indented pins.

2. Device according to the claim 1 further comprising a base to which said mutually connected ends of said two valves are connected in a swingable fashion.

3. Device according to claim 1, wherein said mutually connected ends of said two valves are provided, within said interstice, with anchoring means of the at least one sachet at the side opposite to said openable side.

4. Device according to claim 3, wherein said anchoring means include at least one transversal pin borne by one of said valves and engageable into a complementary seat of the other valve, said at least one pin being designed to pass through a corresponding hole formed on said side of the at least one sachet opposite to said openable side.

5. Device according to claim 4, wherein two said pins are provided to engage into two respective complementary seats.

6. Device according to claim 4, wherein the at least one pin is engageable by pressure or snap fit into said complementary seat.

7. Device according to claim 1, wherein said two valves with said base, said transverse indented pins are made in one piece of molded plastic material, and said connecting ends of said two valves are made with respective integral flexible hinges for pivotal connection to said base.

8. Device according to claim 1, wherein said interstice is designed to house therewithin a pair of said flexible sachets arranged side-by-side.

9. Device according to claim 1, wherein said two valves have respective flat surfaces facing towards said interstice.

10. Device according to claim 1, wherein said two valves have respective convex surfaces facing towards said interstice.

11. Device according to claim 1, wherein said ends of said two valves opposite said ends of mutual connection are spatula-like shaped.

12. Packaging for the dispensing of fluid and semi-dense substances, characterised by the fact it includes a device according claim 1 wherein said mutually connected ends of said two valves are provided, within said interstice, with anchoring means of the at least one sachet at the side opposite to said openable side and further comprising at least one sealed flexible sachet having sealed sides, said at least one sealed flexible sachet being provided in correspondence to one of its sealed sides with at least one through hole.

* * * * *